US005387448A

United States Patent [19]

Watanabe et al.

[11] Patent Number: 5,387,448

[45] Date of Patent: Feb. 7, 1995

[54] EXPLOSION-PROOF PORCELAIN HOUSINGS FOR GAS-FILLED INSULATING APPARATUSES

[75] Inventors: Akihiro Watanabe, Hashima; Keiichi Asai, Kasugai, both of Japan

[73] Assignee: NGK Insulators, Ltd., Japan

[21] Appl. No.: 946,573

[22] Filed: Sep. 18, 1992

[30] Foreign Application Priority Data

Sep. 24, 1991 [JP] Japan ..... 3-273386

[51] Int. Cl.[6] ..... H01B 17/26

[52] U.S. Cl. ..... 428/34.7; 428/34.4; 428/34.6; 174/141 R; 174/142; 174/144; 174/152 R; 174/178; 174/11 BH

[58] Field of Search ..... 428/34.4, 34.6, 34.7; 174/141 R, 142, 143, 144, 148, 152 R, 176, 178, 137 A, 11 BH, 12 BH, 18, 73.1

[56] References Cited

U.S. PATENT DOCUMENTS

| | | | |
|---|---|---|---|
| 3,585,278 | 6/1971 | Quirk | 174/152 |
| 4,431,859 | 2/1984 | Kishida | 174/31 R |
| 4,454,373 | 6/1984 | Kishida | 174/31 R |
| 5,011,717 | 4/1991 | Moriya et al. | 428/34.4 |

FOREIGN PATENT DOCUMENTS 0350289 1/1990 European Pat. Off. .

*Primary Examiner*—Ellis P. Robinson
*Assistant Examiner*—Michael A. Williamson
*Attorney, Agent, or Firm*—Parkhurst, Wendel & Rossi

[57] ABSTRACT

An explosion-proof porcelain housing for a gas-filled insulating apparatus includes a hollow porcelain housing body having a tapered inner surface, and a resin lined on the inner surface of the porcelain housing body. The thickness of the resin lining decreases along the tapered inner surface.

4 Claims, 3 Drawing Sheets

EXPLOSION-PROOF PORCELAIN HOUSINGS FOR GAS-FILLED INSULATING APPARATUSES

BACKGROUND OF THE INVENTION (1) Field of the Invention

The present invention relates to an explosion-proof porcelain housing for a gas-filled insulating apparatus, which porcelain housing can prevent scattering of broken pieces thereof when the porcelain housing is broken due to pressure of the gas inside the gas-filled insulating apparatus, thus preventing a secondary accident.

(2) Related Art Statement

As described in, for example, Japanese patent application Laid-open No. 61-264,612, explosion-proof porcelain housings for gas-filled insulating apparatuses are formerly known, in which an inner surface of a housing body is lined with a resin in a uniform thickness to prevent the above scattering problem. In general, many porcelain housings have tips thinned to form a tapered shape. Efforts for the development have been heretofore made as to how to uniformly line the entire inner surface of the porcelain housing body.

For this reason, the lined thickness of the resin is determined on the basis of a large diameter side of the porcelain housing having low strength against the inner pressure. Consequently, the resin may interfere with a conductor on the smaller diameter side, and the resin is used wastefully.

SUMMARY OF THE INVENTION

The present invention solves the above-mentioned problems, and provides a tapered explosion-proof porcelain housing for a gas-filled insulating apparatus, which gives a uniform effect for preventing scattering of broken pieces to every part of the tapered portion of a housing body, and which diminishes the interference between the lining and the conductor due to an excess thickness of the lining and wasteful use of the resin.

The present invention has been accomplished to solve the above-mentioned problems, and is characterized in that a tapered inner surface of the hollow porcelain housing is lined with a resin in such a thickness that the thickness of the resin is varied depending upon the inner diameter of the hollow portion of the housing body so that the thickness is smaller on a side of a smaller inner diameter portion and greater on a side of a large inner diameter portion.

These and other objects, features and advantages of the invention will be appreciated upon reading of the following description of the invention when taken in conjunction with the attached drawings, with the understanding that some modifications, variations and changes of the same could be made by the skilled person in the art to which the invention pertains without departing from the spirit of the invention or the scope of claims appended hereto.

BRIEF DESCRIPTION OF THE ATTACHED DRAWINGS

For a better understanding of the invention, reference is made to the attached drawings, wherein.

DETAILED DESCRIPTION OF THE INVENTION

Figure 1:
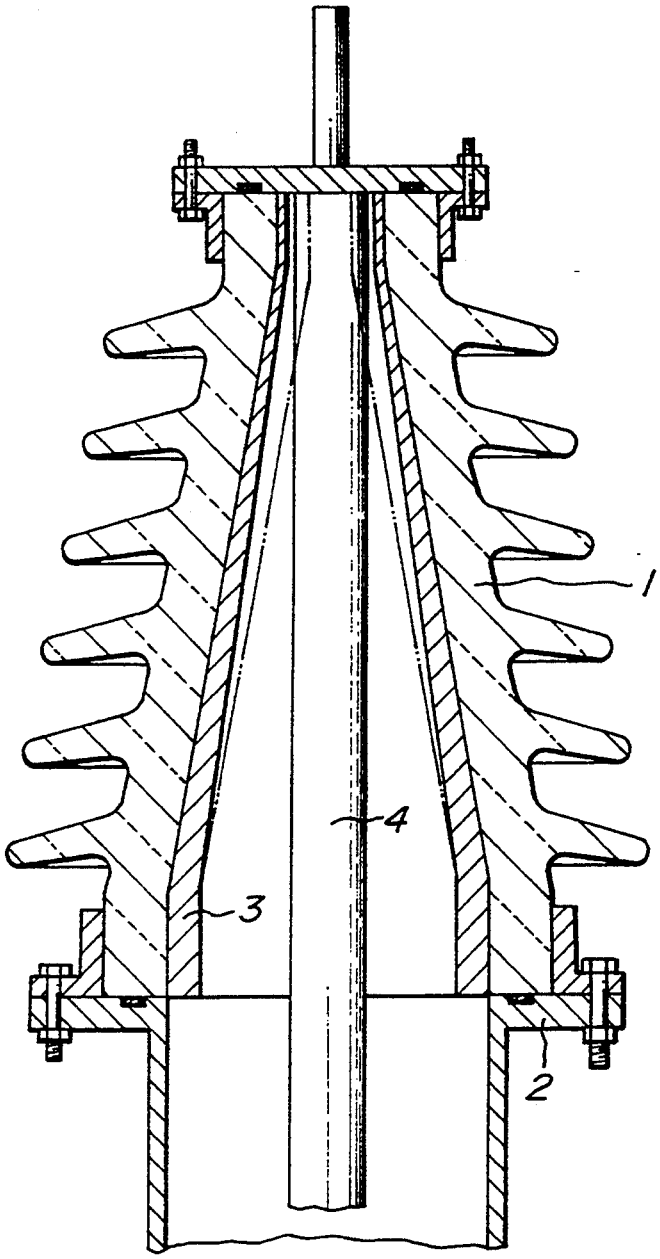
FIG. 1 is a sectional view for illustrating an embodiment of the present invention.

In order to obtain the broken piece scattering-preventing effect in an explosion-proof porcelain housing of this type, it is generally necessary that the magnitude of stress applied to the resin upon destruction of the porcelain housing is suppressed to less than strength of the resin.

According to the inventors' investigation, the maximum stress $\sigma$ applied to the resin is expressed by the internal pressure P acting upon the porcelain housing, the outer diameter of the resin lining (=inner diameter D of the porcelain housing), the inner diameter d of the resin lining and the thickness t of the resin lining as follows:

$$\sigma = P \times (D^2 + d^2)/(D^2 - d^2)$$
$$= P\{D^2/2t(D - t) - 1\}$$

In this formula, D  t. Thus, $$\sigma = P \times (D/2t - 1)$$

Therefore, in order to keep the maximum stress $\sigma$ acting upon the resin at every portion constant of the tapered porcelain housing, the thickness of the resin lining has only to be set to meet the formula: $t = \{P/2(\sigma + P)\} \times D$. As mentioned above, the thickness of the lining may be determined based on mechanical strength of the resin, the internal pressure acting upon the porcelain housing, and the inner diameter of the housing.

In the case of the resin having high mechanical strength, the necessary thickness of the lining may be set substantially in inverse proportion to the strength. In this case, it is necessary to use, as the lining, a material such as rubbery elastic material, which has excellent adhesion to the porcelain and can mitigate difference in thermal expansion between the porcelain and the resin. If the adhesion is insufficient, the resin will no longer sufficiently function to prevent scattering of broken pieces of the porcelain. Further, if the coefficient of thermal expansion greatly differs between the porcelain and the lining, large difference in thermal expansion occurs between the porcelain and the lining due to changes in temperature. If the resin does not have sufficient elasticity, such difference in thermal expansion cannot be mitigated. Consequently, the adhered portion is likely to peel. If the adhesion is strong, it is feared that the porcelain or the resin will be broken.

The internal pressure acting upon the porcelain housing may be determined based on the electrically insulating power and the size of the housing, etc. In the case of the gas-filled porcelain housing for the power transformer plant, the internal pressure of 2 to 6 kgf/cm$^2$ is ordinarily applied. In such an internal pressure, the necessary thickness of the resin is almost proportional to the internal pressure, provided that the resin has certain mechanical strength.

Therefore, when the kind of the resin and the internal pressure applied to the porcelain housing are fixed, the minimum thickness of the resin lining required for preventing the scattering of the broken pieces of the porcelain may be set, and is proportional to the inner diameter of the porcelain housing. In the case of the inner diameter of the porcelain housing which varies continuously as in the case of the tapered porcelain housing, the housing having the uniform effect of preventing the scattering of the broken pieces over the entire housing can be obtained by lining the insulator in such a thickness as being increased in proportion to the inner diameter gradually from the smaller diameter side to the large diameter side.

Figure 4:
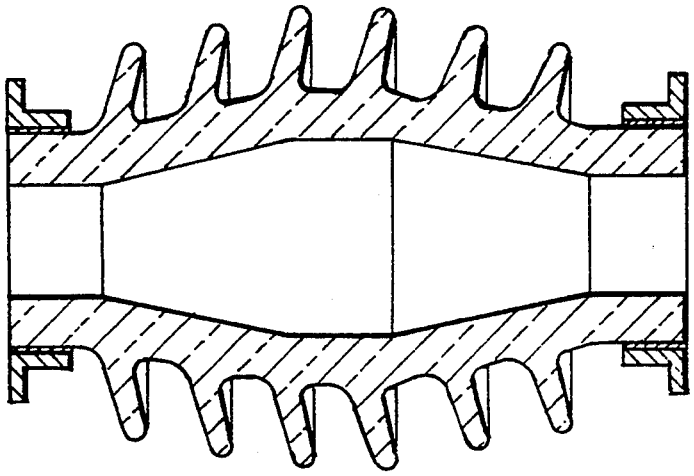
FIGS. 3 and 4 are sectional views of porcelain housings to which the present invention is applicable.
Figure 3:
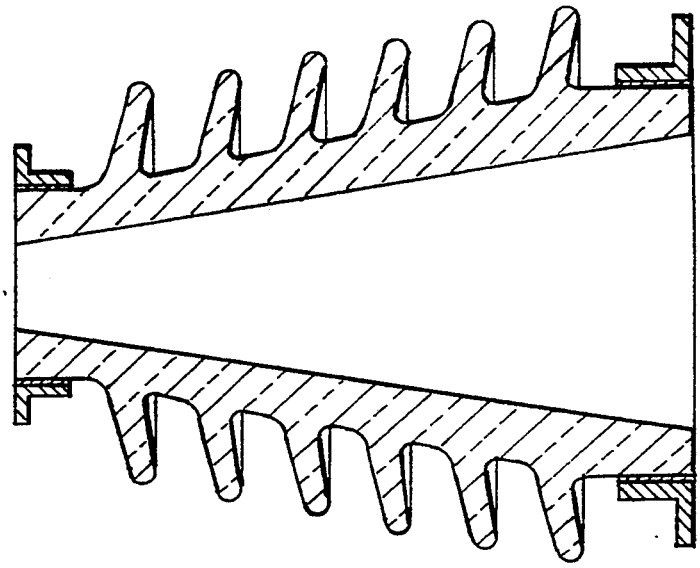

A hollow portion is provided inside the porcelain housing body, and this hollow portion is opened at opposite end thereof. A plurality of shade portions are provided at the outer peripheral surface of the housing body. In general, a flange is bonded to an outer side of each of the opposite ends of the housing body with cement or the like. In some porcelain housing, such flanges are not bonded. As the porcelain housings to which the present invention is applicable, there are porcelain housings as shown in FIGS. 1, 3 and 4, respectively, by way of example. In FIG. 1, the housing includes cylindrical portions and a tapered portion. In FIG. 3, the entire housing is tapered. In FIG. 4, the housing has a barrel shape in which the opposite end portions have a smaller diameter than that of the central portion. The tapered lining may be realized by providing an lining in a larger thickness at the larger diameter portion and in a small thickness at the smaller diameter portion.

As the resin used in the present invention, various rubbers such as urethane rubber, natural rubber, silicon rubber and butyl rubber and various resins such as ionomer, polypyrene, polyethylene, ethylene-vinyl acetate copolymer, and styrene-butadiene resin may be used. Further, as the liner, linings having a single layer and plural layers may be employed.

In order to attain the object of the present invention, for example, the thickness of the resin lining may be varied to be in proportion to the inner diameter of the porcelain housing. In order to vary the thickness of the lining, various methods may be employed. For example, a resin having an appropriate viscosity and a given gelation time is employed, and an inclined angle and the number of revolutions of the porcelain housing are adjusted to balance centrifugal forces acting upon the resin with the gravitational force, and the moving speed of a resin-discharge nozzle is gradually slowed toward the larger diameter side, thereby controlling the thickness of the resin.

Figure 2:
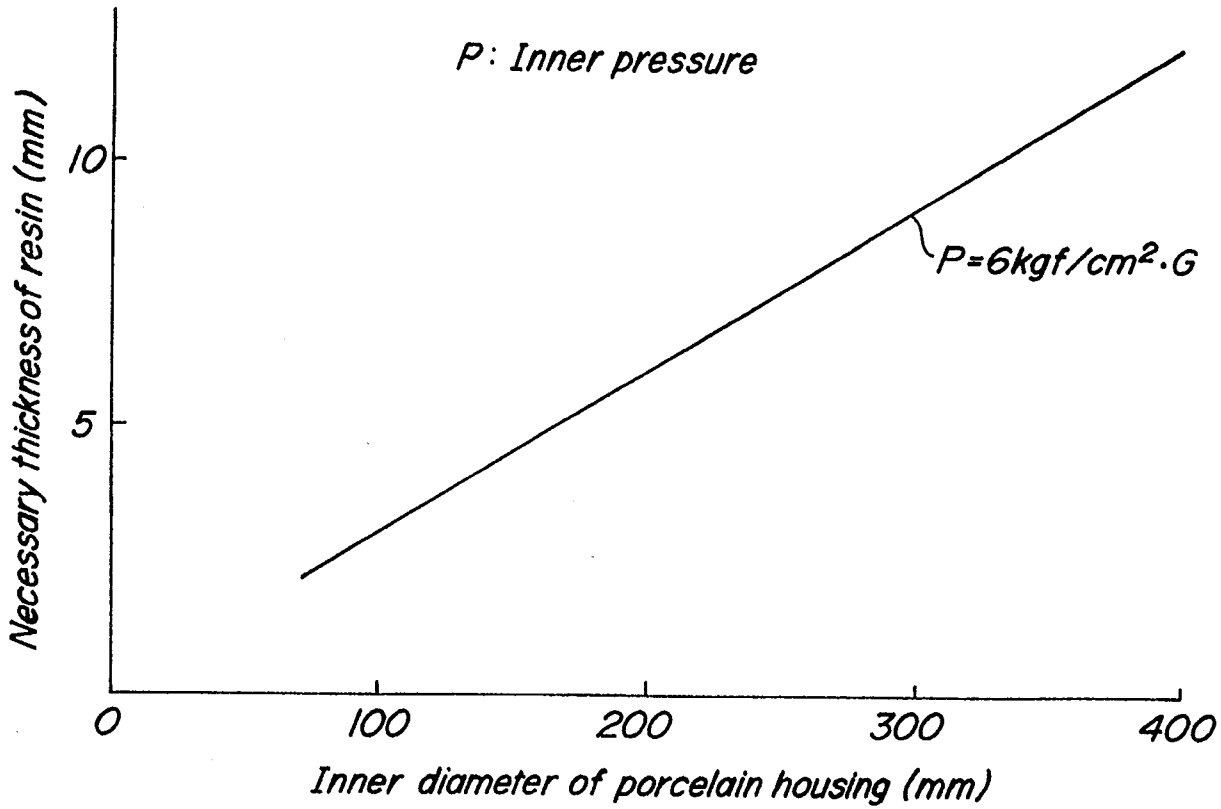
FIG. 2 is a graph showing the relationship between the inner diameter of the porcelain housing and the necessary thickness of the resin lining.

Next, an embodiment of the present invention will be explained as follows:

In FIG. 1, a tapered hollow porcelain housing body 1 is fixed to a mounting area of a gas-filled insulating apparatus 2. The inner surface of the porcelain housing 1 is lined with a resin 3. In this embodiment, polyurethane is used as the resin. For example, with respect to the porcelain housing for a gas bushing in which the inner diameter of the porcelain housing body 1 is 170 mm on the smaller diameter side and 400 mm on the large diameter side, the total length is 2500 mm and the use pressure is 6 kg/cm$^2$, the necessary thickness of the resin is substantially proportional to the inner diameter of the porcelain housing body 1 as shown in the graph of FIG. 2, and the necessary thickness of the resin is 5 mm on the smaller inner diameter side and 12 mm on the larger inner diameter side.

In FIG. 1, a conventional porcelain housing is also illustrated except that a lining is shown by one-dot-chain lines. The inner surface of the porcelain housing is uniformly lined with the resin in a thickness of 12 mm which is equal to that on the larger inner diameter side in the above embodiment of the present invention. When the amount of the resin required in this conventional technique is taken as 100, the amount of the resin used in the present invention is about 75. Thus, the use amount of the resin can be reduced by about 25% in the present invention. Thus, a large economical effect can be attained.

Further, a conductor 4 is passed through a central portion of the porcelain housing body 1, and the conventional porcelain housing has the problem that the conductor interferes with the resin on the smaller inner diameter side of the porcelain housing. To the contrary, according to the present invention, since the thickness of the resin is small on the smaller inner diameter side, such a problem can be diminished.

As having been explained above, according to the explosion-proof porcelain housing for the gas-filled insulating apparatus, since the thickness of the resin lined onto the tapered inner surface of the porcelain housing body is varied such that the thickness is smaller on the smaller inner diameter side and greater on the larger inner diameter side, the broken piece scattering-preventing effect can be afforded upon every portion of the porcelain housing body. Further, the interference with the conductor and wasteful use of the resin due to the lining in excess thickness can be diminished.

Therefore, the present invention greatly contributes to industrial development of porcelain housings for gas-filled insulating apparatuses, which solves the above-mentioned problems possessed by the prior art.

What is claimed is:

1. An explosion-proof porcelain housing for a gas-filled insulating apparatus, said porcelain housing comprising:

a hollow porcelain housing body having a tapered inner surface thereby defining a first end having a first inner diameter, and a second end having a second inner diameter, said second inner diameter being smaller than said first inner diameter; and a scatter reducing resin layer lined on the inner surface of the porcelain housing body, wherein a thickness of the resin lining decreases along the inner surface from said first end to said second end and wherein the maximum stress $\sigma$ acting upon said resin layer at each portion of said tapered porcelain housing is substantially constant.

2. The explosion-proof porcelain housing according to claim 1, wherein the thickness of the resin lining is varied substantially in proportion to the inner diameter of the porcelain housing body.

3. The explosion-proof porcelain housing according to claim 1, wherein the resin is selected from the group consisting of urethane rubber, natural rubber, silicon rubber, butyl rubber, polypyrene, polyethylene, ethylene-vinyl acetate copolymer, and styrene-butadiene resin.

4. The explosion-proof porcelain housing according to claim 1, wherein the thickness of the resin layer is not less than $\{P/2(\sigma+P)\}\times D$, wherein $\sigma$=maximum stress applied to the resin, P=internal pressure acting on the porcelain housing and D=an inner diameter of the porcelain housing.

* * * * *